US008662190B2

(12) United States Patent
Watson

(10) Patent No.: US 8,662,190 B2
(45) Date of Patent: Mar. 4, 2014

(54) FLOW SHAPER FOR USE IN CORRIDOR SPRINKLER

(75) Inventor: Jason Watson, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 209 days.

(21) Appl. No.: 13/286,620

(22) Filed: Nov. 1, 2011

(65) Prior Publication Data

US 2013/0105605 A1 May 2, 2013

(51) Int. Cl.

| | |
|---|---|
| ***B05B 1/26*** | (2006.01) |
| *A62C 31/02* | (2006.01) |
| *A62C 37/08* | (2006.01) |
| *A62C 37/11* | (2006.01) |

(52) U.S. Cl.

USPC ..... 169/37; 239/500; 239/502; 239/522; 239/524

(58) Field of Classification Search

USPC ..... 169/37, 41, 56–58; 239/498, 500, 239/502–504, 518, 521–524; D23/213, 214

See application file for complete search history.

(56) References Cited

U.S. PATENT DOCUMENTS

| | | | |
|---|---|---|---|
| 783,826 | A | 2/1905 | Dinkel |
| 1,674,480 | A | 6/1928 | Nelson |
| 1,836,528 | A | 12/1931 | Dyson |
| 1,877,046 | A | 9/1932 | Phillips |
| 1,900,632 | A | 3/1933 | Boardman |
| 2,005,600 | A | 6/1935 | Tappen |
| 2,230,179 | A | 1/1941 | Cid |
| 2,314,754 | A | 3/1943 | Baird |
| 2,375,528 | A | 5/1945 | De Flon |
| 2,488,234 | A | 11/1949 | Perry |
| 2,558,450 | A | 6/1951 | Martin |
| 3,061,204 | A | 10/1962 | Macinnes et al. |
| 3,106,347 | A | 10/1963 | Hayes |
| 3,198,258 | A | 8/1965 | Werner |
| 3,561,537 | A | 2/1971 | Dix et al. |
| 3,768,736 | A | 10/1973 | Cox |
| 3,769,736 | A | 11/1973 | Nydam |
| 3,802,512 | A | 4/1974 | Todtenkopf |
| 3,877,527 | A | 4/1975 | Johnson |
| 3,904,126 | A | 9/1975 | Allard |
| 3,911,940 | A | 10/1975 | Johnson |
| 3,924,687 | A | 12/1975 | Groos |
| 3,955,762 | A | 5/1976 | Cassimatis et al. |
| 3,991,829 | A | 11/1976 | Johnson |
| 4,091,873 | A | 5/1978 | Werner |
| 4,113,021 | A | 9/1978 | Werner |
| 4,121,665 | A | 10/1978 | Woycheese |
| 4,167,974 | A | 9/1979 | Job |

(Continued)

*Primary Examiner* — Darren W Gorman

(74) *Attorney, Agent, or Firm* — Harness, Dickey & Pierce, P.L.C.

(57) ABSTRACT

A corridor sprinkler includes a first flow shaper member supported by a support for shaping the flow of fluid from a sprinkler that includes a shelf portion having a proximal end and a distal end, the shelf being generally parallel to and spaced from the axis of the flow passage through the sprinkler body. A shield extends directly from the distal end of the shelf and generally perpendicular to the axis and partially intersecting the column of fluid without the support obstructing the column of fluid between the discharge opening and the shield. The shelf and the shield can each have a diameter greater than a diameter of the discharge opening. A second flow shaper can extend from the support on an opposite side of the axis from the first flow shaper and partially intersecting the column of fluid.

20 Claims, 2 Drawing Sheets

(56) References Cited

U.S. PATENT DOCUMENTS

| | | | | | |
|---|---|---|---|---|---|
| 4,279,309 | A | | 7/1981 | Fischer et al. | |
| 4,296,815 | A | * | 10/1981 | Mears | 169/37 |
| 4,296,816 | A | | 10/1981 | Fischer | |
| 4,350,302 | A | | 9/1982 | Gruber et al. | |
| 4,403,661 | A | | 9/1983 | Tokar | |
| 4,405,018 | A | | 9/1983 | Fischer | |
| 4,570,720 | A | | 2/1986 | Retzloff et al. | |
| 4,623,023 | A | | 11/1986 | Retzloff et al. | |
| 4,657,085 | A | | 4/1987 | Jacobsen | |
| 4,660,765 | A | | 4/1987 | Rosenberg | |
| 4,700,893 | A | | 10/1987 | Bugler, III | |
| 4,987,957 | A | * | 1/1991 | Galaszewski | 169/37 |
| 5,188,185 | A | | 2/1993 | Mears | |
| 5,297,737 | A | | 3/1994 | Davisson | |
| 5,366,160 | A | | 11/1994 | Balderrama | |
| 5,392,990 | A | | 2/1995 | Iwata et al. | |
| 5,392,993 | A | | 2/1995 | Fischer | |
| 5,505,383 | A | | 4/1996 | Fischer | |
| 5,560,430 | A | | 10/1996 | Enos | |
| 5,647,438 | A | | 7/1997 | Chatrathi et al. | |
| 5,722,599 | A | | 3/1998 | Fries | |
| 5,727,737 | A | | 3/1998 | Bosio et al. | |
| 5,810,263 | A | | 9/1998 | Tramm | |
| 5,829,684 | A | | 11/1998 | Fishcer | |
| 5,839,667 | A | | 11/1998 | Fishcer | |
| 6,367,559 | B1 | * | 4/2002 | Winebrenner | 169/37 |
| D550,807 | S | * | 9/2007 | Franson et al. | D23/213 |
| D552,711 | S | * | 10/2007 | Franson et al. | D23/213 |
| 7,854,269 | B2 | | 12/2010 | Franson et al. | |
| 2005/0067171 | A1 | * | 3/2005 | Green | 169/16 |
| 2006/0219817 | A1 | * | 10/2006 | Franson et al. | 239/502 |

* cited by examiner

FIG 1
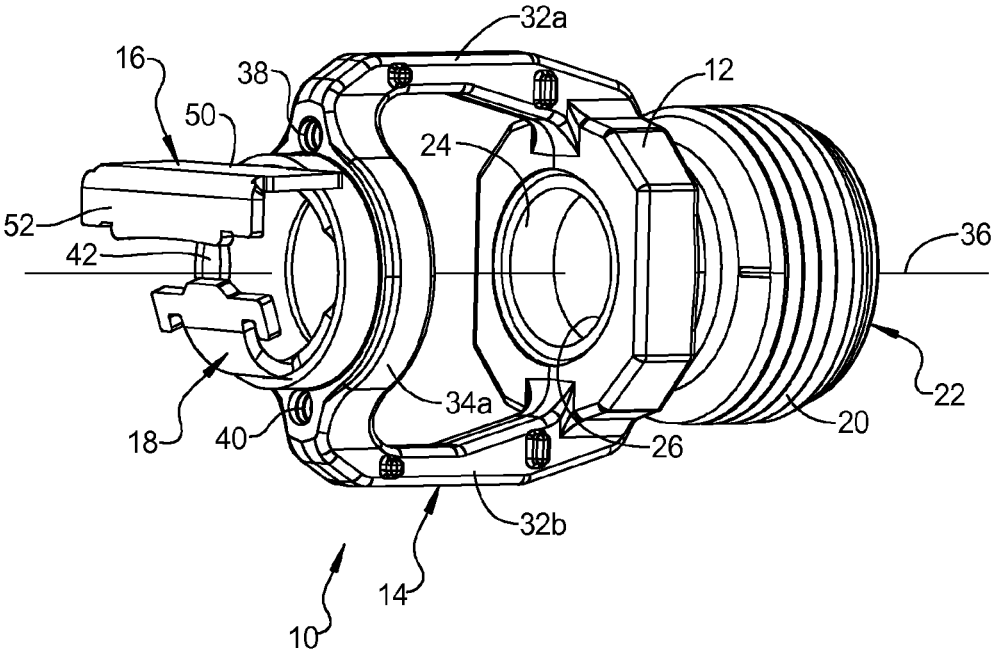
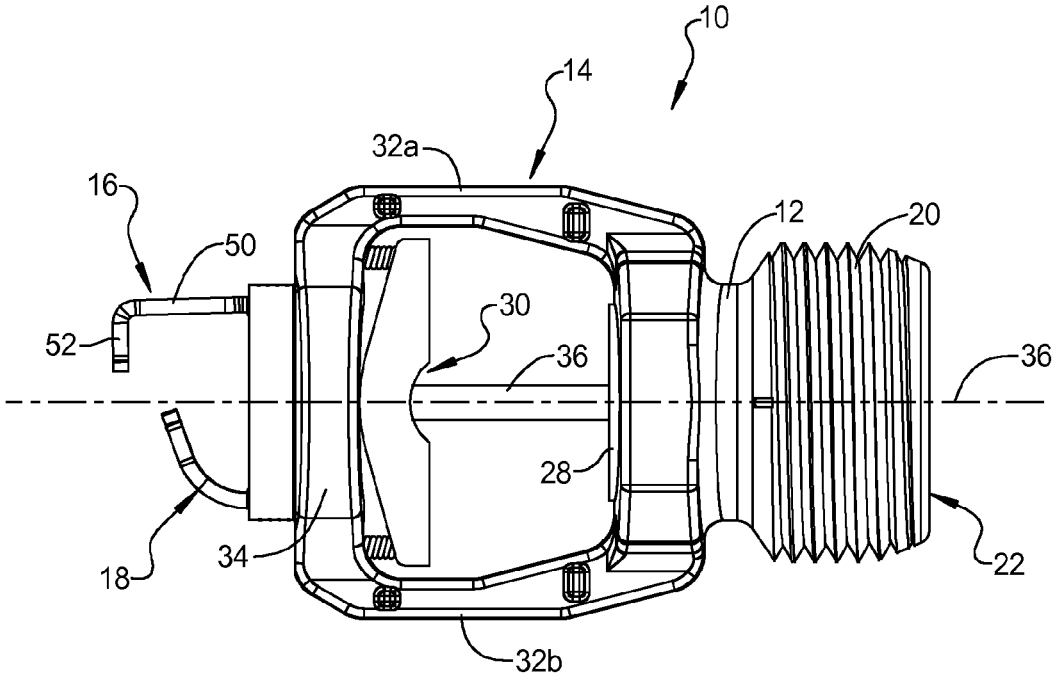
FIG 2

FLOW SHAPER FOR USE IN CORRIDOR SPRINKLER

FIELD

The present disclosure relates to a sprinkler assembly and, more particularly, to a corridor sprinkler assembly that exhibits reduced energy losses.

BACKGROUND

This section provides background information related to the present disclosure which is not necessarily prior art.

Significant energy losses occur at the fire protection sprinkler assemblies where the fluid is dispersed. Conventional sprinkler assemblies include a base with a passageway, an inlet opening, and a discharge opening, which is adapted for connecting to the system piping, and a deflector that is supported spaced from the base, typically by a pair of frame arms that extend from the base. The frame arms are often joined at their distal ends by a boss, which is used to mount the deflector to the frame arms. The boss is typically aligned with the discharge opening of the base. Pendent sprinklers and upright sprinklers typically include deflectors with a solid central portion and a plurality of tines that extend radially outwardly from the central portion for dispersing the fluid as it flows across the solid central portion, which is mounted to the boss. Sidewall sprinklers typically include a deflector, also with a solid central portion with tines extending from the central portion and a blade that is positioned above the central portion to direct the fluid that flows above the central portion outwardly and downwardly. In each case, when the fluid flows from the discharge opening of the base the fluid impinges on the boss and on the central portion of the deflector. The boss and deflector disperse the fluid radially outward, relative to the axis of the discharge opening, and the fluid is thereafter further dispersed by the tines, and in the case of the sidewall sprinklers also by the blade. This results in a sizeable energy or head loss in the fluid at the sprinkler assembly.

Significant savings can be realized for a sprinkler system if the supply pressure to the sprinkler assembly can be reduced. As would be understood by those skilled in the art, where the supply pressure to the sprinkler assemblies of a system can be reduced, the size of the piping delivering the fluid to the sprinkler assemblies can be reduced and/or the size of the system pump can be downsized. If comparable performance of a sprinkler assembly can be provided at a lower pressure for any given system, the need for a pump might even be avoided. Any of these modifications could provide significant savings in the installation cost of a fire protection system. Accordingly, a sprinkler assembly that can disperse fluid with a reduced head loss may reduce the required pressure at the sprinkler assembly and, hence, provide cost savings for the installation of a fire protection system incorporating such sprinkler assemblies.

SUMMARY

This section provides a general summary of the disclosure, and is not a comprehensive disclosure of its full scope or all of its features.

A corridor sprinkler includes a first flow shaper member supported by a support for shaping the flow of fluid from a sprinkler that includes a shelf portion having a proximal end and a distal end, the shelf being generally parallel to and spaced from the axis of the flow passage through the sprinkler body. A shield extends directly from the distal end of the shelf and generally perpendicular to the axis and partially intersecting the column of fluid without the support obstructing the column of fluid between the discharge opening and the shield. The shelf and the shield can each have a diameter greater than a diameter of the discharge opening. A second flow shaper can extend from the support on an opposite side of the axis from the first flow shaper and partially intersecting the column of fluid.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure. The drawings shown are all drawn to scale.

FIG. 1 is a perspective view of a sprinkler assembly of the present disclosure with the closure device and trigger removed for clarity;

FIG. 2 is a side view of a sprinkler assembly of the present disclosure;

Corresponding reference numerals indicate corresponding parts throughout the several views of the drawings.

DETAILED DESCRIPTION

Figure 3:
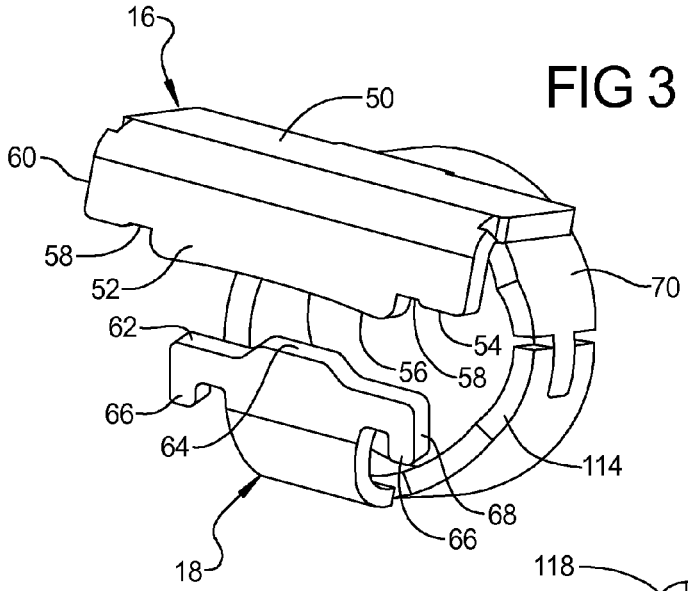
FIG. 3 is a perspective view of the flow-shaper members of the sprinkler assembly of FIG. 1.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, the numeral 10 generally designates a sprinkler assembly of the present invention. As will be more fully described below, sprinkler assembly 10 is configured and arranged to reduce the energy loss of the fluid as it flows from the sprinkler assembly 10. The term "fluid" is used broadly herein and includes substances that are capable of flowing, for example, water, foam, water/foam mixture, gas, powder, and other known fire suppressant materials. In the illustrated embodiment, sprinkler assembly 10 is illustrated as a sidewall, corridor sprinkler assembly 10. In addition, as described below, the sprinkler of the present disclosure may be used in residential or commercial applications, including storage applications, and, further, may be configured to operate in a control mode or a suppression mode. Hence, their "K" factor may vary, where the "K" factor equals the flow of fluid, such as water, in gallons per minute through the passageway divided by the square root of the pressure of fluid fed into the inlet of the sprinkler body in pounds per square inch gauge. For example, the "K" factor of the sprinkler assemblies of the present disclosure may be in a range of about 2.8 to 50.4.

Further, the sprinkler assembly of the present disclosure may be configured as a fast response sprinkler as defined by the response time index. The response time index of a sprinkler is referred to as "RTI", which is a measure of the sensitivity of the thermal element of a sprinkler. RTI is usually determined by plunging a sprinkler into a heated laminar airflow within a test oven. RTI is calculated using operating time of the sprinkler, operating temperature of the sprinkler's heat-responsive element (as determined in a bath test), air temperature of the test oven, air velocity of the test oven, and the sprinkler's conductivity. Fast response sprinklers have an RTI typically less than 50 $(\text{m-s})^{1/2}$.

As will be more fully described below, the sprinkler assembly 10 of the present disclosure reduces the friction between the fluid and the sprinkler assembly and, hence, the energy loss of the fluid as it flows from the sprinkler assembly. Consequently, a sprinkler assembly of the present disclosure provides an optimally-sized sprinkler that will be able to cover greater areas for a given pressure than conventional sprinklers of the same size.

As best seen in FIG. 1, sprinkler assembly 10 includes a sprinkler body 12, a support 14 that extends from body 12, and upper and lower fluid flow-shaper members 16, 18. Body 12 and support 14 preferably comprise an integrally formed unitary brass casting. Though, it should be understood that the body 12 and support 14 may be separately formed and, further, may be formed from other materials and by other forming methods. Body 12 comprises a generally tubular body that can have a threaded portion 20 for connecting the sprinkler assembly to a fluid supply line and, further, includes an inlet opening 22, a discharge opening 24, and a fluid passageway 26. Passageway 26 extends between inlet opening 22 through threaded portion 20 to discharge opening 24 so that when body 12 is coupled to the supply line and sprinkler assembly 10 is opened or actuated, such as in the case of a fire, fluid will flow from inlet opening 22 through passageway 26 and out from discharge opening 24.

As seen in FIG. 2, sprinkler assembly 10 further includes a closure device (28) releasably positioned at discharge opening 24 of body 12 to close passageway 26. A heat responsive trigger 30 is mounted in a manner to releasably retain closure device 28 at discharge opening 24 of body 12 to thereby maintain passageway 26 closed until trigger 30 is activated.

To reduce the energy loss of the fluid as it flows from sprinkler assembly 10, support 14 is configured to allow at least a portion and, optionally most, if not all, of the fluid to flow through support 14 rather than into and around the support 14. In addition, as will be more fully described below, at least a portion, and optionally most of the fluid flows between upper and lower flow-shaper members 16, 18, which direct and shape the fluid in a desired pattern in contrast to conventional sprinkler assemblies that typically include frames and deflectors that deflect and redirect the fluid and form barriers around which the fluid must flow.

In the illustrated embodiment, support 14 comprises a frame that includes a pair of arms 32*a* and 32*b* and a transverse member 34 that joins the ends of arms 32*a* and 32*b* and which is spaced from discharge opening 24. Arms 32*a* and 32*b* extend generally away from discharge opening 24 on opposed sides of body 12 and, as noted, are joined by transverse member 34. While two symmetrically positioned arms are illustrated, it should be understood that support 14 may include one, two, three, or four or more arms, for example three or four arms that are all symmetrically positioned around and spaced away from axis 36 of the passageway 26. As would be understood by those skilled in the art, support 14 is substantially rigid so as to provide support for the flow-shaper members 16, 18 and, further, support for a heat responsive trigger 30, as will be more fully described below.

In the illustrated embodiment in FIGS. 1 and 2, transverse member 34 of support 14 comprises an annular portion 34*a* and a pair of bosses 38, 40 that align and mount the annular portion 34*a* between arms 32*a* and 32*b*. The annular portion 34*a* provides an opening 42 with a center axis that is at least generally aligned along longitudinal axis 36 of sprinkler assembly 10 and spaced from discharge opening 24. The opening 42 can be round, square, rectangular, oblong, or another shape. In the illustrated embodiment axis 36 comprises a generally central axis that passes through the centers of the inlet and discharge openings. The alignment of the discharge opening 24 and opening 42 in the transverse member 34 allows the body 12 and support 14 to be integrally molded by a casting process wherein a single core member or a pair of coaxial core members can be utilized to co-axially form the openings 24 and 42.

The opening or the innermost diameter 42 of the annular member is at least 0.4 inches in diameter and, more typically, in a range of about 0.5 to 2.5 inches in diameter. Further, opening 42 may be at least as large in diameter as discharge opening 24 and, further, may be larger in diameter than discharge opening 24. In this manner, the flow of fluid from body 12 is substantially unimpeded by support 14 and, instead, may flow through support 14 through opening 42. As a result, the flow of fluid is directed and shaped rather than redirected. Consequently, the energy loss of the fluid as it flows through the support 14 is reduced, if not eliminated. Furthermore, although opening 42 is depicted as a right cylindrical opening with a stepped side, the inner surface of opening 42 may be tapered inwardly or outwardly.

In order to then direct the fluid in a desired spray pattern, upper and lower fluid flow-shaper members 16, 18 are located adjacent or at opening 42, and can be downstream of the opening 42 as shown. Further, flow-shaper members 16, 18 may be offset from axis 36 of the sprinkler head body so as not to intersect the axis 36.

As best seen in FIG. 3, the upper fluid flow-shaper member 16 includes an upper shelf portion 50 that is generally parallel to the longitudinal axis 36 of the sprinkler head body and a shield portion 52 generally perpendicular to the longitudinal axis 36. In the embodiment shown, the upper shelf portion 50 is approximately two degrees from parallel. By "generally parallel" and "generally perpendicular," it is meant that the upper shelf is within several degrees from parallel and the shield is within several degrees from perpendicular to the axis 36. The upper shelf portion 50 can be planar in shape and can have a width (W1) greater than a diameter of the inner diameter of the opening 42 of the transverse member 34 of the support 14. The upper shelf portion 50 can also be curved, angled, or otherwise bent as desired to provide a desired flow pattern.

The shield 52 can be attached to a distal end of the upper shelf 50. The shield can have a width (W2) generally equal to the width (W1) of the upper shelf portion 50. Alternatively, the shield 52 can be wider or narrower than the upper shelf portion depending upon a desired spray pattern of the sprinkler. The shield 52 can include a distal edge 54 having a protruding portion 56 and pair of recessed regions 58 flanking the protruding portion 56 and laterally inward from the outer edges 60 of the shield 52. The shape of the distal edge 58 can be modified to obtain a desired spray pattern for a specific application. The shield portion 52 of the upper fluid flow shaper 16 can extend toward the longitudinal axis 36 by a desired distance in order to provide a desired spray pattern. In the embodiment shown, the shield portion 52 does not intersect the longitudinal axis 36 and is spaced from the longitudinal axis 36.

The lower fluid flow-shaper 18 extends upward from a lower edge of the opening 42 toward the longitudinal axis 36 and can have an arcuate shape at its origin and a planar shape at its distal end. The distal edge 62 of the lower flow-shaper 18 includes a central protruding portion 64. The lower flow-shaper 18 also can include a pair of tabs 66 extending rearwardly from lateral sides 68 of the flow-shaper 18. The shape of the lower fluid flow-shaper 18 can be modified to provide a desired spray pattern for a given application. The lower flow-shaper 18 can extend toward and be spaced from the longitudinal axis 36 by a distance less than the upper flow-shaper 16 is spaced from the longitudinal axis 36.

Referring to FIG. 2, when fluid flows from discharge opening 24, the fluid generally forms a column of fluid, which is substantially unencumbered by any structure until it contacts flow-shaper members 16, 18. In other words, sprinkler assembly 10 has a flow path from discharge opening 24 that is unencumbered or unobstructed by support 14. Furthermore, when the fluid is contacted by flow-shaper members 16, 18, flow-shaper members 16, 18 operate on the column of fluid from its outer surface radially inward—in contrast to a conventional deflector and frame, which act as abutments and then redirect the fluid and spread the column of fluid generally from its center to fan the fluid radially outward and, thereafter, disperses the fluid as the fluid flows around the deflector. As would be understood, therefore, in a conventional sprinkler, the fluid experiences significant energy loss due to the friction and deflection between the fluid and the frame and the deflector.

In the illustrated embodiment, fluid flow-shaper members 16, 18 are formed as a pair of tabs that are mounted to or formed with an annular transverse member 34. The flow-shaper members 16, 18 can be attached to a ring 70. In this manner, the fluid flow-shaper members 16, 18 are attached to support 14 by mounting ring member 70 in support 14. It should be understood that flow-shaper members 28 may alternatively be attached to support 14 by attaching flow-shaper members 28 to support 14, for example by welding the flow-shaper members to the support, such as to annular member 34*a*, or by integrally forming the support 14 with the flow-shaper members. Flow-shaper members 16, 18 can be formed, cut or otherwise machined into the support structure so as to be formed integrally therewith. Alternately, tabs 16, 18 may be mounted by a member that mounts about support 14 and annular member 34 outwardly of opening 42.

In this application, opening 42 of annular member 34 is preferably at least as large in diameter as discharge opening 24. In this manner, most, if not all, the fluid discharged from discharge opening 24 may flow through support 14 unimpeded by support 14 or annular member 34.

As noted above, trigger 30 is mounted so as to retain closure device 28 in position over discharge opening 20. In the illustrated embodiment of FIG. 2, trigger 36 comprises a heat sensitive member 36 that is mounted between support 14 and closure device 28, in a manner as described in commonly assigned U.S. Pat. No. 7,854,269. It should be understood that other trigger devices can also be used.

Figure 4:
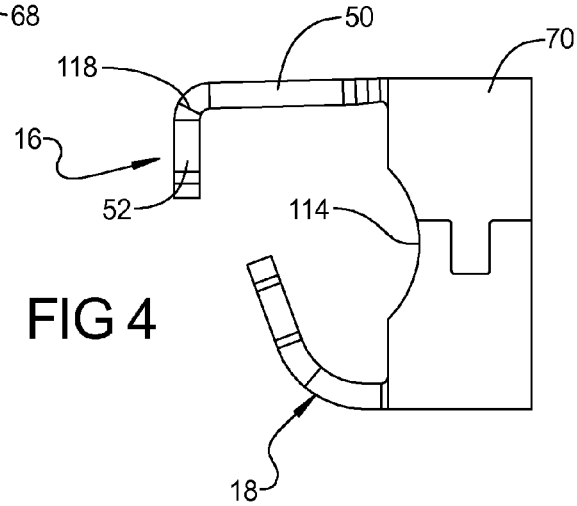
FIG. 4 is a side view of the flow-shaper members of FIG. 3.

Referring to FIG. 4, flow-shaper members are provided by tabs 16, 18, which are formed or otherwise provided on an annular member 70.

Figure 5:
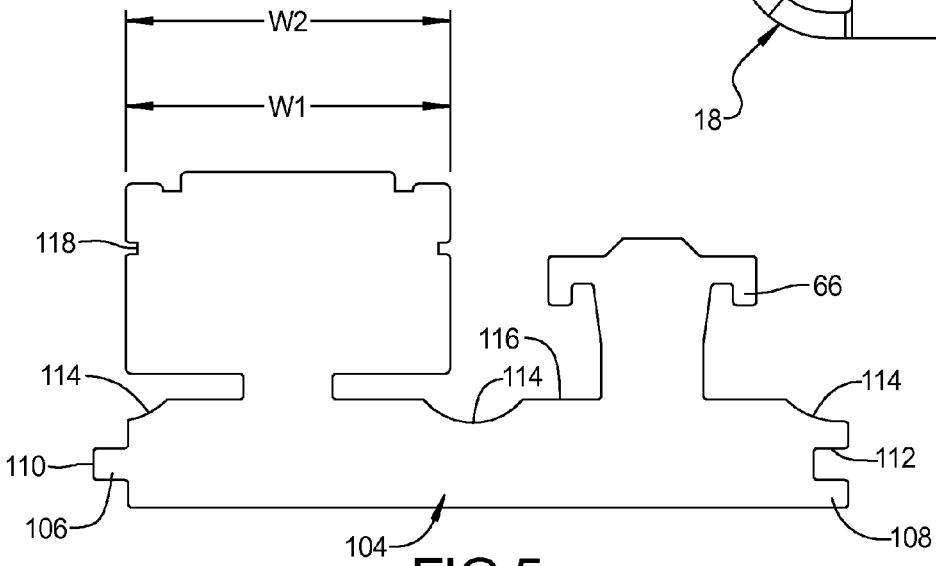
FIG. 5 is a plan view of a blank for forming the flow-shaper members of FIG. 3.

As best seen in FIG. 5, flow-shaper members 16, 18 may be formed with an annular member 70 as a blank 104, with opposed ends 106 and 108 of blank 104 including interlocking features, such as a tab 110 and a recess 112. In addition, annular member 70 may be provided with arcuate indentations or cut-outs 114 at its upper edge 116. In forming the flow shaper members, the blank 104 is formed into a ring 70 so that tab 110 is received in recess 112. The upper flow shaper member 16 is then formed by bending the shield portion 52 approximately 90 degrees relative to the shelf portion 50 along the parting line 118. The shelf portion 50 can also be bent relative to the ring 70, as desired. The lower flow shaper member 18 can be bent or curved toward the central axis. The bending and forming steps can be performed by hand or by automated techniques using fixtures or stampings. The upper flow shaper member 16 can extend axially beyond the lower flow shaper member 18 by an amount that can be at least 30 percent and preferably approximately fifty percent further than the axial extent of the lower flow shaper member 18. The lower flow shaper member 18 is angled approximately relative to perpendicular to the central axis and can be in a plane intersecting a junction between the shelf 50 and shield 52. The width of the lower flow shaper member 18 can be narrower than an inner diameter of the opening 42.

What is claimed is:

1. A sprinkler assembly comprising:

a body including a passageway, an inlet opening, a discharge opening, and an axis extending through said discharge opening, wherein water delivered to said passageway flows as a column of fluid from said discharge opening, said column of fluid having a diameter generally equal to a diameter of said discharge opening;

a support extending from said body;

a first flow-shaper member supported by said support for shaping the flow of fluid from said discharge opening, said first flow-shaper member having a shelf portion having a proximal end and a distal end with said proximal end being located closer to said discharge opening than said distal end, said shelf extending from said support at said proximal end and being generally parallel to and spaced from said axis, a shield extending directly from said distal end of said shelf and generally perpendicular to said shelf and said axis and partially intersecting said column of fluid, said shelf and said shield each having a width greater than the diameter of said discharge opening.

2. The sprinkler assembly according to claim 1, wherein said shield is generally planar.

3. The sprinkler assembly according to claim 1, wherein said shelf is generally planar.

4. A sprinkler assembly comprising:

a body including a passageway, an inlet opening, a discharge opening, and an axis extending through said discharge opening, wherein water delivered to said passageway flows as a column of fluid from said discharge opening, said column of fluid having a diameter generally equal to a diameter of said discharge opening;

a support extending from said body;

a first flow-shaper member supported by said support for shaping the flow of fluid from said discharge opening, said first flow-shaper member having a shelf portion having a proximal end and a distal end with said proximal end being located closer to said discharge opening than said distal end, said shelf extending from said support at said proximal end and being generally parallel to and spaced from said axis, a shield extending directly from said distal end of said shelf and generally perpendicular to said axis and partially intersecting said column of fluid, said shelf and said shield each having a width greater than the diameter of said discharge opening, wherein said shield includes a proximal end connected to said shelf and a distal end, said distal end including an edge having at least one protruding portion.

5. The sprinkler assembly according to claim 1, wherein said support includes an annular member.

6. The sprinkler assembly according to claim 1, further comprising a second flow shaper extending from said support on an opposite side of said axis from said first flow shaper member and partially intersecting said column of fluid without any obstruction of said column of fluid between said discharge opening and said second flow shaper.

7. The sprinkler assembly according to claim 6, wherein said second flow shaper includes a proximal end and a distal end with said distal end defining an edge having at least one protruding portion.

8. The sprinkler assembly according to claim 6, wherein said second flow shaper includes a pair of tabs extending from lateral sides thereof.

9. The sprinkler assembly according to claim 6, wherein neither of said first and second flow shapers intersect said axis.

10. A sprinkler assembly comprising:

a body including a passageway, an inlet opening, a discharge opening, and an axis extending through said discharge opening in a horizontal plane, wherein water delivered to said passageway flows as a column of fluid from said discharge opening, said column of fluid having a diameter generally equal to a diameter of said discharge opening;

a support extending from said body;

a first flow-shaper member supported by said support for shaping the flow of fluid from said discharge opening, said first flow-shaper member having a shelf portion disposed above said horizontal plane and having a proximal end and a distal end with said proximal end being located closer to said discharge opening than said distal end, said shelf extending from said support at said proximal end and being spaced from said axis, a shield extending directly from said distal end of said shelf and generally perpendicular to said shelf and said axis and partially intersecting said column of fluid without any obstruction of said column of fluid between said discharge opening and said shield;

a second flow shaper extending from said support on an opposite side of said axis from said first flow shaper member and partially intersecting said column of fluid.

11. The sprinkler assembly according to claim 10, wherein neither of said first and second flow shapers intersect said axis.

12. The sprinkler assembly according to claim 10, wherein said second flow shaper includes a pair of tabs extending from lateral sides thereof.

13. The sprinkler assembly according to claim 10, wherein said second flow shaper includes a proximal end and a distal end with said distal end defining an edge having at least one protruding portion.

14. The sprinkler assembly according to claim 10, wherein said support includes an annular member.

15. A sprinkler assembly comprising:

a body including a passageway, an inlet opening, a discharge opening, and an axis extending through said discharge opening in a horizontal plane, wherein water delivered to said passageway flows as a column of fluid from said discharge opening, said column of fluid having a diameter generally equal to a diameter of said discharge opening;

a support extending from said body;

a first flow-shaper member supported by said support for shaping the flow of fluid from said discharge opening, said first flow-shaper member having a shelf portion disposed above said horizontal plane and having a proximal end and a distal end with said proximal end being located closer to said discharge opening than said distal end, said shelf extending from said support at said proximal end and being spaced from said axis, a shield extending directly from said distal end of said shelf and generally perpendicular to said shelf and said axis and partially intersecting said column of fluid without any obstruction of said column of fluid between said discharge opening and said shield;

a second flow shaper extending from said support on an opposite side of said axis from said first flow shaper member and partially intersecting said column of fluid, wherein said shield includes a proximal end connected to said shelf and a distal end, said distal end including an edge having at least one protruding portion.

16. The sprinkler assembly according to claim 10, wherein said shelf is generally planar.

17. The sprinkler assembly according to claim 10, wherein said shield is generally planar.

18. A sprinkler assembly comprising:

a body including a passageway, an inlet opening, a discharge opening, and an axis extending through said discharge opening in a horizontal plane, wherein water delivered to said passageway flows as a column of fluid from said discharge opening, said column of fluid having a diameter generally equal to a diameter of said discharge opening;

a support extending from said body;

a first flow-shaper member supported by said support for shaping the flow of fluid from said discharge opening, said first flow-shaper member having a shelf portion disposed above said horizontal plane and having a proximal end and a distal end with said proximal end being located closer to said discharge opening than said distal end, said shelf extending from said support at said proximal end and being spaced from said axis, a shield extending directly from said distal end of said shelf and generally perpendicular to said axis and partially intersecting said column of fluid without any obstruction of said column of fluid between said discharge opening and said shield;

a second flow shaper extending from said support on an opposite side of said axis from said first flow shaper member and partially intersecting said column of fluid, wherein said second flow shaper has an end portion disposed in a plane that intersects said first flow shaper member at an intermediate location along said first flow shaper member.

19. The sprinkler according to claim 18, wherein said intermediate location is generally at an intersection between said shelf portion and said shield portion.

20. A sprinkler assembly comprising:

a body including a passageway, an inlet opening, a discharge opening, and an axis extending through said discharge opening in a horizontal plane, wherein water delivered to said passageway flows as a column of fluid from said discharge opening, said column of fluid having a diameter generally equal to a diameter of said discharge opening;

a support extending from said body;

a first flow-shaper member supported by said support for shaping the flow of fluid from said discharge opening, said first flow-shaper member having a shelf portion disposed above said horizontal plane and having a proximal end and a distal end with said proximal end being located closer to said discharge opening than said distal end, said shelf extending from said support at said proximal end and being spaced from said axis, a shield extending directly from said distal end of said shelf and generally perpendicular to said axis and partially intersecting said column of fluid without any obstruction of said column of fluid between said discharge opening and said shield;

a second flow shaper extending from said support on an opposite side of said axis from said first flow shaper member and partially intersecting said column of fluid, wherein said first flow shaper member extends an axial distance of at least 30 percent further than said second flow shaper.

* * * * *

UNITED STATES PATENT AND TRADEMARK OFFICE

CERTIFICATE OF CORRECTION

PATENT NO. : 8,662,190 B2
APPLICATION NO. : 13/286620
DATED : March 4, 2014
INVENTOR(S) : Jason Watson It is certified that error appears in the above-identified patent and that said Letters Patent is hereby corrected as shown below:

In the Specification:

At column 6, line number 33, delete “28” and insert --16, 18-- therefor.

At column 6, line number 35, delete “28” and insert --16, 18-- therefor.

At column 6, line number 49, delete “20” and insert --24-- therefor.

At column 6, line number 50, delete “36” and insert --30-- therefor.

In the Claims:

At column 9, line number 6, in Claim 15, after “shield;”, insert --and-- therefor.

At column 9, line number 38, in Claim 18, after “shield;”, insert --and-- therefor.

At column 10, line number 32, in Claim 20, after “shield;”, insert --and-- therefor.

Signed and Sealed this
Twenty-seventh Day of May, 2014

Michelle K. Lee

Michelle K. Lee
*Deputy Director of the United States Patent and Trademark Office*